US005559591A

United States Patent [19]

Kato et al.

[11] Patent Number: 5,559,591

[45] Date of Patent: Sep. 24, 1996

[54] IMAGE FORMING APPARATUS WITH FUNCTION OF REQUESTING EXCHANGE OF FIXING UNIT

[75] Inventors: Motoi Kato; Haruo Fujii; Toshifumi Moritani, all of Yokohama; Tatsuya Kobayashi, Tokyo; Tetsuya Kobayashi, Kawasaki; Toshiaki Miyashiro, Ichikawa; Naoki Enomoto; Akihiko Uchiyama, both of Yokohama; Yoshiro Saito, Kawasaki, all of Japan

[73] Assignee: Canon Kabushiki Kaisha, Tokyo, Japan

[21] Appl. No.: 460,520

[22] Filed: Jun. 2, 1995

Related U.S. Application Data

[63] Continuation of Ser. No. 079,920, Jun. 23, 1993, abandoned.

[30] Foreign Application Priority Data

Jun. 26, 1992 [JP] Japan ..... 4-191374

[51] Int. Cl.[6] ..... G03G 15/20; G03G 15/22

[52] U.S. Cl. ..... 355/283; 15/256.51

[58] Field of Search ..... 355/282, 283, 355/284, 285, 290, 295, 300; 219/216, 469–471; 15/256.52, 256.51, 256.53; 432/60; 118/60

[56] References Cited

U.S. PATENT DOCUMENTS

| | | | |
|---|---|---|---|
| 3,941,558 | 3/1976 | Takiguchi | 355/300 X |
| 4,557,588 | 12/1985 | Tomosada | 355/284 X |
| 4,782,359 | 11/1988 | Tomoe | 219/216 X |
| 4,791,448 | 12/1988 | Kawashima et al. | 355/290 |
| 4,926,218 | 5/1990 | Fukao | 355/283 |
| 4,939,552 | 7/1990 | Nakanishi | 355/283 X |
| 5,023,464 | 6/1991 | Mitsuya et al. | 355/283 |
| 5,168,314 | 12/1992 | Gunji et al. | 355/283 |
| 5,201,852 | 4/1993 | Ogoshi | 255/283 X |

FOREIGN PATENT DOCUMENTS

| | | |
|---|---|---|
| 58-221876 | 12/1983 | Japan . |
| 1-197782 | 8/1989 | Japan . |
| 4-140780 | 5/1992 | Japan . |
| 4-159586 | 6/1992 | Japan . |

*Primary Examiner*—Arthur T. Grimley
*Assistant Examiner*—Shuk Yin Lee
*Attorney, Agent, or Firm*—Fitzpatrick, Cella, Harper & Scinto

[57] ABSTRACT

An image forming apparatus including image forming unit for forming an unfixed image on a recording medium, a pair of fixing rotary members for fixing the unfixed image on the recording medium, a cleaning member for cleaning surfaces of the fixing rotary members, the fixing rotary members and the cleaning member being an integral unit separable from the apparatus, detection unit for detecting remaining quantity of the cleaning member, and a unit for requesting the exchange of the integral unit of the fixing rotary member pair and the cleaning member in response to the output of the detection unit.

3 Claims, 6 Drawing Sheets

IMAGE FORMING APPARATUS WITH FUNCTION OF REQUESTING EXCHANGE OF FIXING UNIT

This application is a continuation of prior application Ser. No. 08/079,920 filed on Jun. 23, 1993, now abandoned.

BACKGROUND OF THE INVENTION

1. Field of the Invention

The present invention relates to an image forming apparatus having a pair of fixing rotary members for fixing an unfixed image and a cleaning member for cleaning surfaces of the fixing rotary members.

2. Related Background Art

Conventionally, in an electro-photographic copying machine or printer, a thermal fixing system in which an unfixed sheet is passed through a pair of heated and pressured rollers has commonly been used. A heat-resistive releasing lubricant layer such as silicone rubber or fluoride resin from molten toner is provided on the surfaces of the rollers and other releasing lubricant such as silicone oil is applied to the surfaces to prevent the offset. Nevertheless, offset toner accumulated on the surfaces of the rollers deteriorate the rollers, so that the life thereof is shortened.

To solve this problem, cleaning is commonly performed by forced friction with a fibrous web pad to remove the offset toner from the surfaces of the rollers. The rollers, oil and cleaning member as consumption member are normally exchanged by a service man or a user one to several times during a lifetime of the apparatus.

Particularly, in a full color image forming apparatus, it is necessary to fix a thick toner layer of multi-color including yellow, cyan, magenta and black. An output close to a solid image not only a line image is required. As a result, a durability load is significantly large in comparison of a mono-color or dicolor system. Further, since those toners must be perfectly in a fused and mixed condition in order to enhance color development and color mixing, the toner resins used should be soluble sharply at a relatively low temperature and have a small viscosity. Such resin has a much poor releasing property from the rollers than that of mono-color material.

Accordingly, in order to maintain the releasing effect in the roller having a silicone rubber of fluoride resin surface, it is necessary to cover the surface with silicone oil to impart the releasing effect to prevent the offset phenomenon and the deterioration of the roller.

It has been contemplated to reduce the amount of oil used as much as possible to save manpower for exchange, reduce the size of an oil tank and simplify the application mechanism, but still it is troublesome to exchange the rollers and the web, and it is very difficult for the user to do it by himself.

SUMMARY OF THE INVENTION

It is an object of the present invention to provide an image processing apparatus capable of facilitating maintenance of a fixing unit.

It is another object of the present invention to provide an image forming apparatus enabling a user to conduct the exchange of a fixing roller and a cleaning web.

It is other object of the present invention to provide an image forming apparatus which comprises:

image forming means for forming an unfixed image on a recording medium;

a pair of fixing rotary members for fixing the unfixed image on the recording medium;

a cleaning member for cleaning surfaces of the fixing rotary members;

the fixing rotary members and the cleaning member being an integral unit separable from the apparatus;

detection means for detecting remaining quantity of the cleaning member; and means for requesting the exchange of the unit in response to the output of the detection means.

Other objects of the present invention will be apparent from the following detailed description of the present invention.

DETAILED DESCRIPTION OF THE PREFERRED EMBODIMENTS

Figure 1:
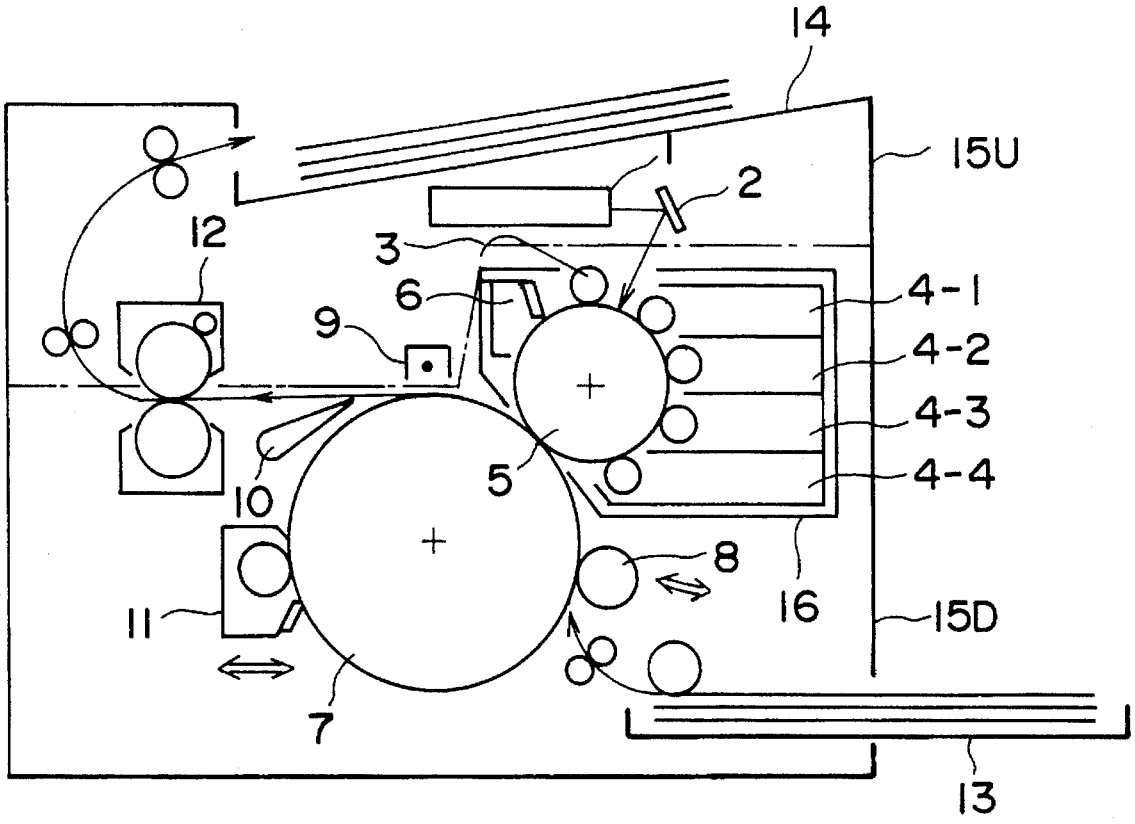
FIG. 1 shows a sectional view of a construction of a first embodiment of the present invention.

FIG. 1 shows a sectional view of an image forming apparatus in one embodiment of the present invention.

In FIG. 1, latent image is formed sequentially every one color on a surface of a photo-sensitive drum 5 charged by a primary charging roller 3 to have a potential which is maintained constant, by controlling positioning and exposure by a laser beam directed from a laser scanner 1 through a mirror 2 in accordance with a color image signal. Such color latent images are visualized and developed by corresponding color developing units (4-1 to 4-4). The transfer is made each time the development of one color is completed. At this moment, a sheet has been transported onto a transfer drum 7 from a cassette 7 and it is wrapped around the surface of the drum by electrostatic sucking means of a sucking roller 8 or mechanical means of a gripper. Visualized images on the photo-sensitive drum are positioned onto the sheet for each color to form a multi-color transferred image. The sequence of latent image forming, development and transfer may start from any one of the four colors Y, M, C and Bk.

When the transfer of four colors is over, the charges for sucking are discharged in the sheet by a separation charger 9, and simultaneously the sheet is heated and pressured by a fixing unit 12 which is mechanically separated from the transfer drum by function of a separation pawl 10, so that the unfixed toner images on the surface are fused, mixed and fixed, and then the sheet is transported to a sheet tray 14 at the top.

Residual charges on the surface of the transfer drum are then discharged by the charger 9. The contamination on the surface is cleaned by a transfer drum cleaner 11, which is separated from the transfer drum 7 while the sheet is wrapped around there, so that it does not disturb the image on the sheet. The sucking roller 8 is similar to that mentioned above. The photo-sensitive drum 5 is cleaned by the cleaner 6 at a downstream position from the transfer position where the image is transferred to the transfer drum, and then uniformly charged by the charging roller 3. The above process is repeatedly carried out.

In an experiment, the photo-sensitive drum is an aluminum cylinder having a diameter of 80 mm coated with an organic semiconductor. It has a dark potential of −600 V and a light potential of −100 V. The development is a non-magnetic one-component system. Negative non-magnetic toner is slide-applied to a development sleeve by an application roller (not shown), and a charging characteristic and the amount of application are controlled by a function of an elastic blade (not shown). The toner is flown by the action of a DC-AC composite applied bias to a clearance of approximately 200–300 μm between the development sleeve and the photo-conductive drum to develop the drum latent images. In order to suck the sheet onto the transfer drum 7, a high voltage is applied between the transfer drum 7 and the sucking roller 8, and a voltage is applied between the photoconductor drum 5 and the transfer drum 7 upon the transfer. In the present embodiment, a four-color developing unit, the photo-conductive drum and the cleaning unit are integrally assembled as a cartridge unit 16. Since it is not relevant to the content of the present invention, the detail of the technology is omitted here.

Figure 2:
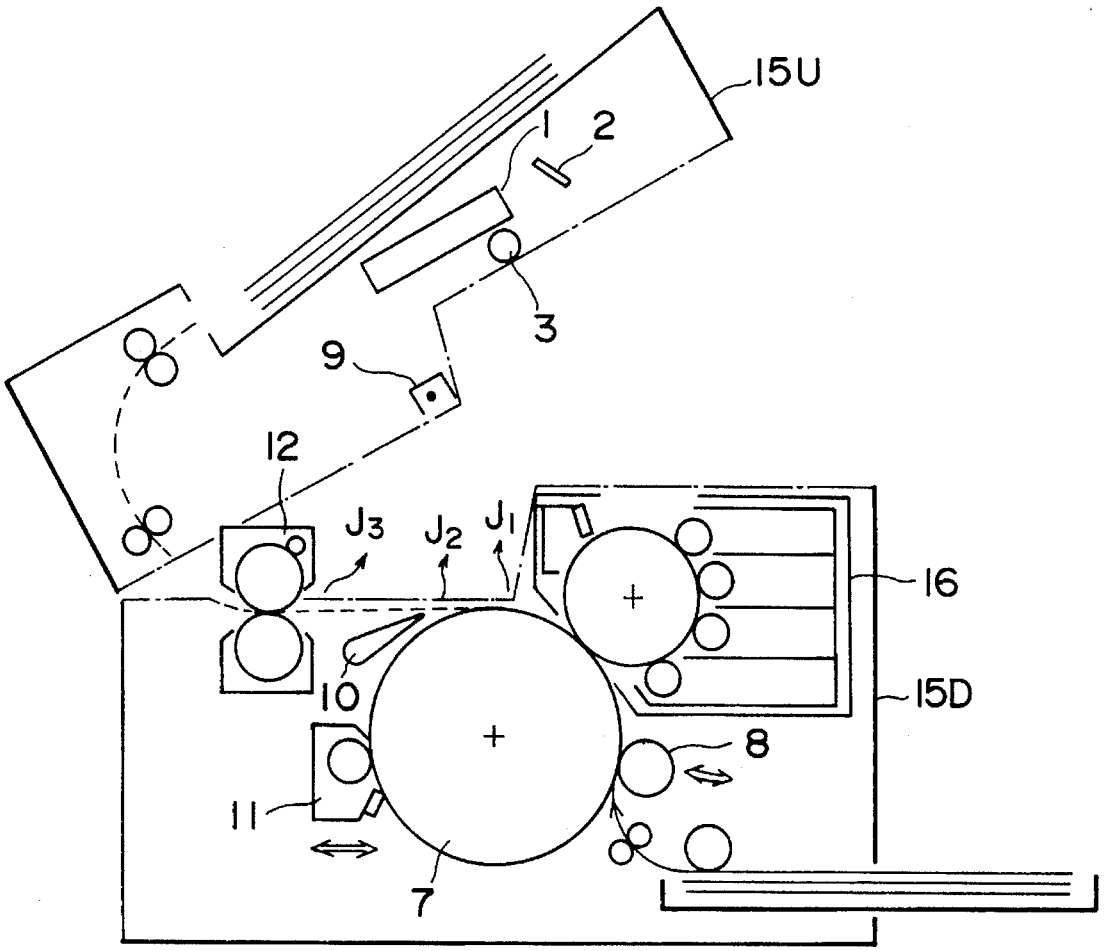
FIG. 2 shows a sectional view in which a top cover of the apparatus of FIG. 1 is opened.

A casing in the present embodiment can be divided into an upper first casing 15U and a lower second casing 15D as shown by chain lines. FIG. 2 shows a divided and opened position of the apparatus. The first casing is opened while it is coupled to the second casing to allow operations for jamming and the exchange and maintenance of the cartridge, the fixing unit and the transfer drum. An optical system such as the scanner 1 and the mirror 2 is arranged in the upper casing to prevent the contamination by the scattering toner. The cartridge, the fixing unit and the transfer drum having large volumes and weights are arranged in the lower casing to minimize a weight load to the upper casing as much as possible. The cartridge, the transfer drum and the cleaning unit are not inclined even when the upper casing is opened, so that there is no risk of falling down of the toner. The fixing unit is also not inclined, so that there is no risk of oil leakage. In the present embodiment, the loading of the sheet cassette, the operation for the jam and the exchange of the units including the fixing unit and the operation of the front console panel can be conducted from the front plane (a right side plane in the drawing), so that a high operability for the user is attained.

Figure 3:
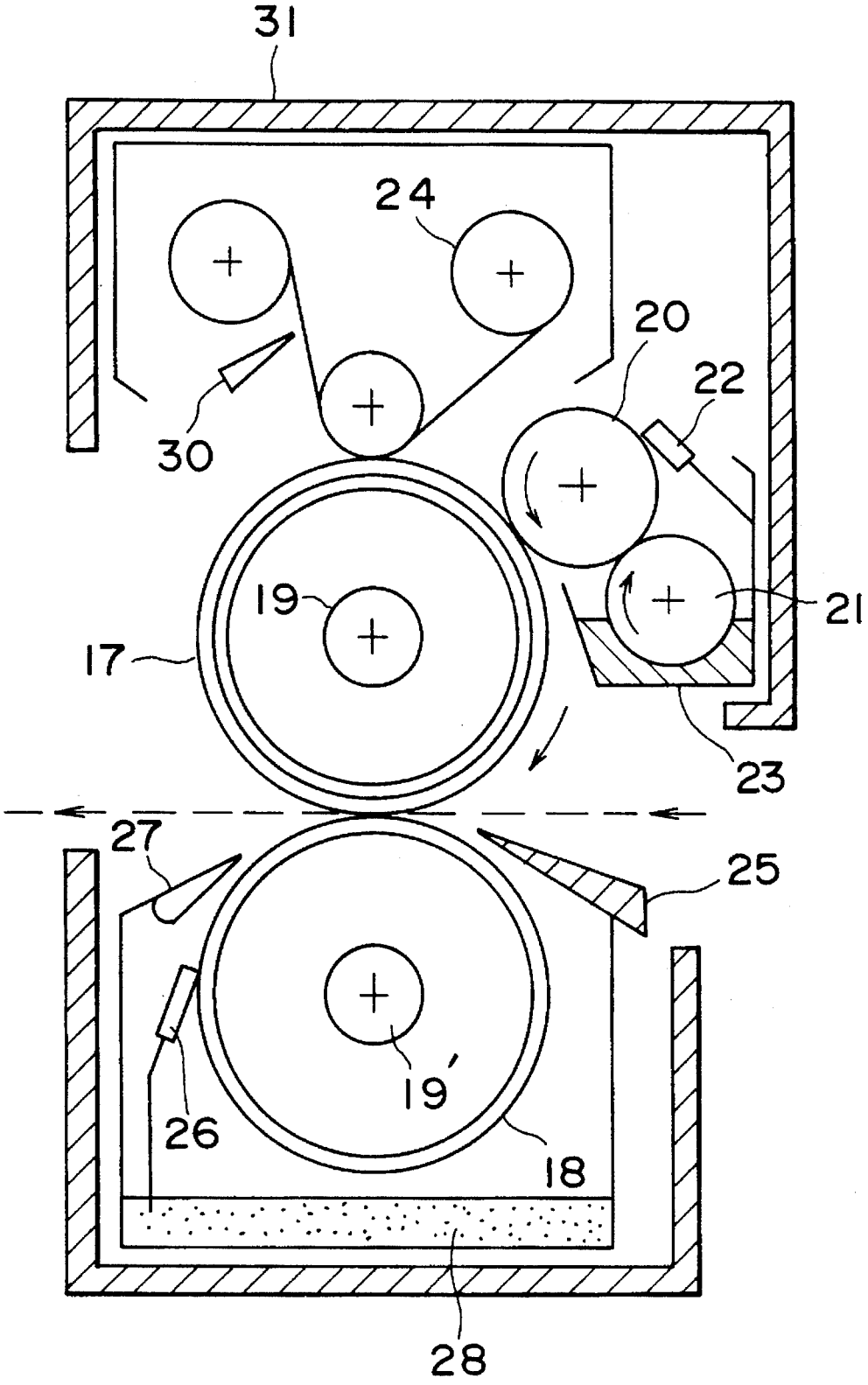
FIG. 3 shows a sectional view of a construction of a fixing unit used in the first embodiment.

A color fixing unit of the present embodiment is now explained. In FIG. 3, numeral 17 denotes a fixing roller which is pressed to a pressure roller 18. Heat required for the fixing is applied by halogen heaters 19 and 19' in the rollers, and a roller temperature is detected by a change in resistance of a thermistor (not shown) abutted to the surface of the roller or a core material thereof to control the temperature. Silicone oil in an oil tank 23 is pumped up by a pump-up roller 21, the amount of application is controlled by a blade 22 on an application roller 20 and it is applied to the surface of the fixing roller 17.

The unfixed image sheet is fed to a nip from the right of FIG. 2, and is pressed and heated by the surface of the fixing roller having a smoothing oil layer formed thereon, thus it is fixed thereby and ejected. The surface used for the fixing is rotated to fictionally contact to the cleaning web 24 which is a non-woven fiber having oil impregnated thereto to remove offset toner Then, oil is again applied. The fixing roller 17 has an elastic layer of at least several tens μm at a core shaft such as aluminum to cope with the thickness of mono-color to multi-color toner of the color image (several to several tens μm). If the elasticity is low, depressed areas of the toner are not fixed or the toner is collapsed, so that a resolution power is lowered. Phenyl or dimethyl liquid-like silicone rubber such as RTV type or LTV type has a sufficient elasticity. RTV is preferable because it has good affinity to the silicone rubber and is easy to oil application. A surface layer may be RTV or LTV and an underlying layer may be a HTV which is resistive to heat to form a multi-layer structure which prevents thermal deterioration and the peel-off of the surface layer.

Alternatively, PFA or PTFE coated tube of several tens μm may be provided on the surface. Since the pressure roller 18 may have a lower elasticity than that of the fixing roller 1, only HTV or fluoride rubber may be provided on an aluminum core shaft, or PFA coating may be provided on the surface to prevent oil swelling.

A material of the oil commonly used presently is dimethyl system of silicone oil such as KF-96 by Shin-Etsu Chemical Co., Ltd. The viscosity may be lower than several tens thousands cs and preferably lower than several thousands cs. When it is lower than several tens cs, a volatility is high and charged wires in the apparatus are easily contaminated and a firing point is low, so it has a problem in safety. Accordingly, 100 cs or higher is preferable.

In the present embodiment, the fixing roller surface layer is of RTV and the pressure roller surface layer is of LTV. The toner used is sharp melt toner used in color copying machine CLC-200 by Canon K.K. The fixing temperature is 120°–180° C. with a ripple of ±3° C., and the roller peripheral speed is 10–90 mm/sec. The oil used is KF-96 of 300 cs.

In the present embodiment, a proper time to exchange the fixing roller and the cleaning web is detected so that they are exchanged as a unit.

Before describing the construction of the present invention, factors, which determine the lifetime of the fixing roller, are explained. The following four factors are considered. First, it is considered that the deterioration of the roller rubber by heat is theoretically inversely proportional to the temperature and proportional to the heating time. In a durability test by heated idling rotation, the rubber layer tear-off lifetime substantially shows such tendency.

Second, the deterioration of swelling of the rubber by the application of the silicone oil is considered. It has been found that it does not significantly affect to the lifetime if the quantity of application of oil is less than 0.05 mg/cm$^2$.

Third, the deterioration by the offset toner is considered, but the manner of offset of the toner widely varies depending on the fixing temperature, and the toner area density. It has been confirmed by various analyses such as by an electronic microscope or a reflection spectrometer that the factor of the deterioration of the roller surface is the reduction of the surface lubrication of the rubber due to the penetration and deposition of binder resin, pigments and dyes of the tonner to the surface. The roller lifetime due to the above is called an offset lifetime which is distinguished from the tear-off lifetime.

The degree of deterioration may be estimated by adding the image area ratio while assuming it as a frequency of deposition of the offset toner to the roller surface. However, in an experiment, the offset ratio is higher in a half-tone image than in a solid image. Accordingly, this should be taken into account when an average degree of deterioration is to be estimated. The mono-color image and the full color image are to be treated as separate modes and different estimation methods are to be applied to each case because colors are overlapped in the full color image and a mono-color half-tone may coexist in the full color image. Further, a plain paper and an OHP sheet are to be treated as separate modes and different estimation methods are to be used because one of the fixing temperature and the speed for the OHP sheet should be changed because of a higher light transmissivity.

The cleaning web, which is a fourth factor, is discussed based on the above discussion. The cleaning web is usually made of a fiber material having silicone oil of a high viscosity impregnated at a small quantity, and it is transported at a much lower speed than the roller peripheral speed by a pulse-controlled solenoid. The transportation speed is designed to have a sufficient margin to cope with a variation of offset amount in the toner of different types of image. The transport length may be regarded to be proportional to the fixing time and the number of sheets to be fixed.

If the transport length of the web and the degree of deterioration of the roller can exactly keep such a proportional relationship and the total length of the web is adjusted to the roller lifetime in advance, it may be regarded that the roller lifetime has been reached when the web is exhausted and the fixing unit which integrally include both of those may be exchanged.

By doing so, a burden of a user to separately exchange those at different times is reduced. Further, when one of the roller and the web reaches its lifetime, the lifetime of the other does not remain and hence there is no waste in exchanging the entire unit.

However, in the conventional apparatus, the transport distance of the web does not show exact proportional relationship with the roller lifetime as seen from the various use conditions of color fixing described above. Even if there is a proportional relationship, it happens only in an apparatus of a special use condition.

As a result of further study on this point while varying the transport distance of the web for various modes, it has been found that the above relationship is maintained by continuously and stably conducting the cleaning of the roller surface irrespective of the change of the offset amount by the mode.

Namely, it has been found that the rate of deterioration of the roller is always maintained constant and the transport distance of the web and the degree of deterioration of the roller are kept in substantially proportional relationship if the transport distance of the web per image is set larger in a mode in which the offset amount is large in average, and the transport distance of the web is set smaller in a mode in which the offset amount is small. Accordingly, by presetting weights of the transport distance of the web for the respective modes, the roller lifetime and the web lifetime are made coincide under various use conditions, so that they may be exchanged simultaneously.

The web transport control in the present embodiment is now explained. The web transport is carried out by converting a fine displacement by ON/OFF of a solenoid to a fine rotation of a web take-up roller. In an experiment, the control of the transport distance in the respective modes is such that the solenoid is actuated by each control signal to transport the web by approximately 0.5 mm, and the number of pulses per number of sheets of image is varied. The weight of the transport distance varies with the roller, toner material, fixing temperature and speed, and an experimental data is explained below.

In the experiment, a difference between the transport distances in the both modes is most large between the plain paper and the OHP sheet, that is, 1 pulse/2 shoots for the OHP sheet is required relative to 1 pulse/10 sheets for the plain paper.

This means that a coefficient $\alpha$ is five times larger in the OHP mode. A coefficient $\beta$ is two times larger for the full color mode than that for the mono-color mode, and a coefficient $\gamma$ is two times larger for the five or more continuous feed mode than that of one-shot mode. The number of pulses $\Delta$ per number of sheets required for the transfer distance of the web is determined by the product of those coefficients for that combination.

The formula is a simple one, that is, $\Delta=10\cdot\alpha\cdot\beta\cdot\gamma$. It is not restrictive but a more complex formula may be used, or the combination may be subdivided to determine more exact coefficients. The print area factor of the image may be further multiplied, or the image density such as half-tone and the solid image may be taken into consideration to make more exact calculation. In this manner, the detection error of the roller lifetime is eliminated and the waste at the exchange is avoided. Table 1 shows a summary of the above factors.

TABLE 1

| | | | |
|---|---|---|---|
| | Plain Paper | | OHP |
| $\alpha$ | 1 | : | 5 |
| | Mono-color | | Full color |
| $\beta$ | 1 | : | 2 |
| | Single Shot (1 to 4) | | Continuous (5 or larger) |
| $\gamma$ | 1 | : | 2 |
| $\delta$ | $\delta_1$ Image print factor (print area/sheet area) | | |
| | $\delta_2$ Image density (half tone-solid image) | | |
| $\Delta$ | Web Transport Distance (Determined by multiplying the above coefficients using plain paper, mono-color, one shot and print factor of 10% as standards) | | |

It is convenient to determine the web transport distance by determining the coefficients for each mode using the plain paper, the mono-color, the single shot (no larger than 4 sheets) and the image print factor of approximately 10% as the standards.

In the fixing unit of the present embodiment, a web detector 30 is provided as shown in FIG. 3, and is lightly abutted against the web. The remaining amount of the web is detected by utilizing the fact that the web supply roller changes a span position at the end of the web. In the present embodiment, the change of position of the detector is detected by a photo-sensor as well known in the art. The detector and the sensor may be installed in the unit so that a maker thereof may collect it for recycling. Alternatively, both may be arranged in the apparatus externally of the unit and an end of the detector may be extended into the unit.

Figure 4:
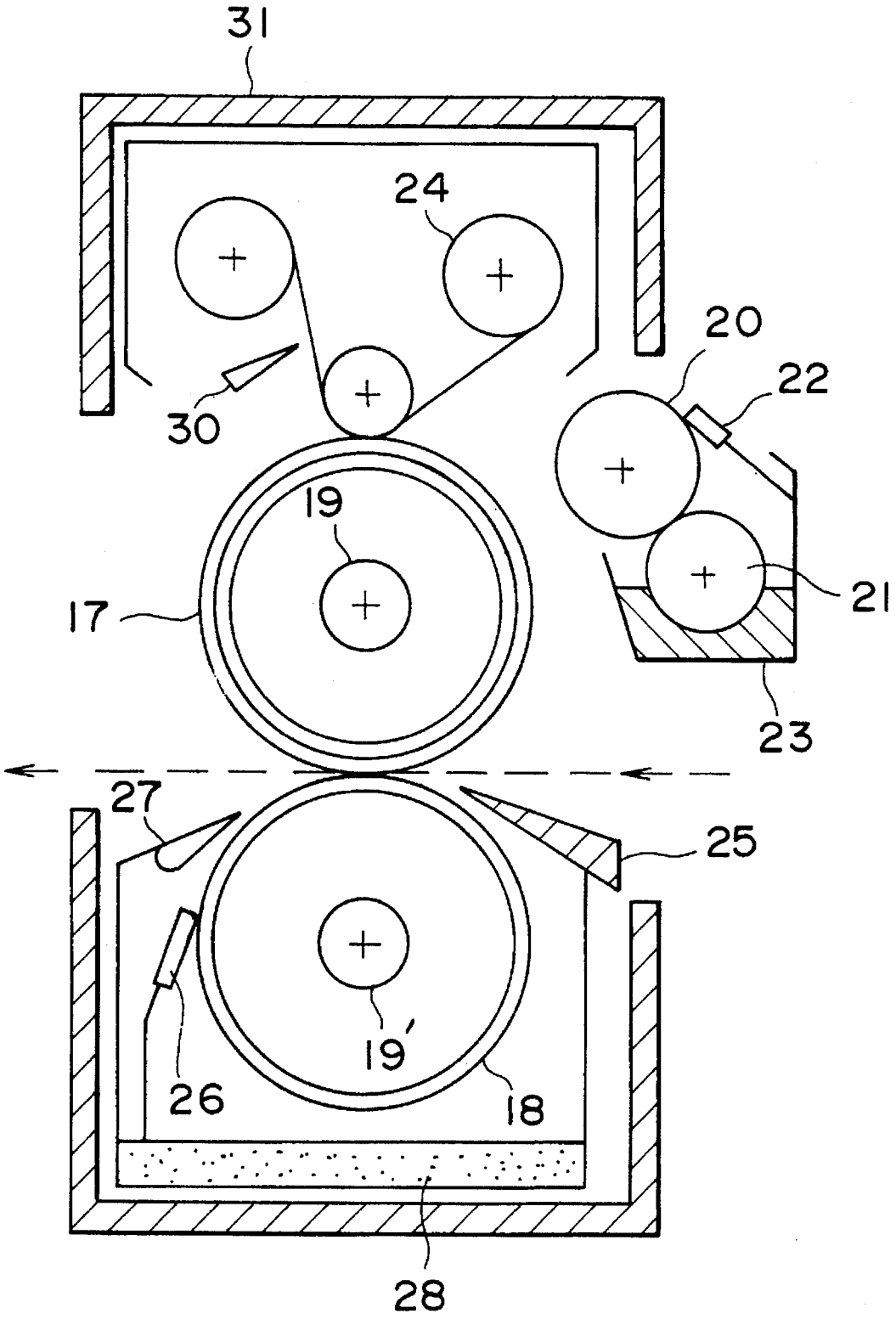
FIG. 4 shows a sectional view of another fixing unit used in another embodiment.

The fixing unit 31 may include an oil application mechanism as shown in FIG. 3, or it may remain in the apparatus as shown in FIG. 4. A shutter or a seal mechanism may act to the unit at the time of exchange to prevent the oil contamination inside and outside the apparatus.

A request of exchange of unit to the user may be displayed on a liquid crystal display of the console panel when the remaining web detection signal is produced. It may be immediately exchanged or the prenotice of the exchange of the unit so that the operation of the apparatus may be continued without interruption until the current job is completed if the apparatus is in operation.

The job may be forcibly terminated but the prenotice system is more friendly for user. It is easy to impart a margin to the web by the number of sheets of the paper cassette when the remaining web detection signal is used for the prenotice.

Figure 5:
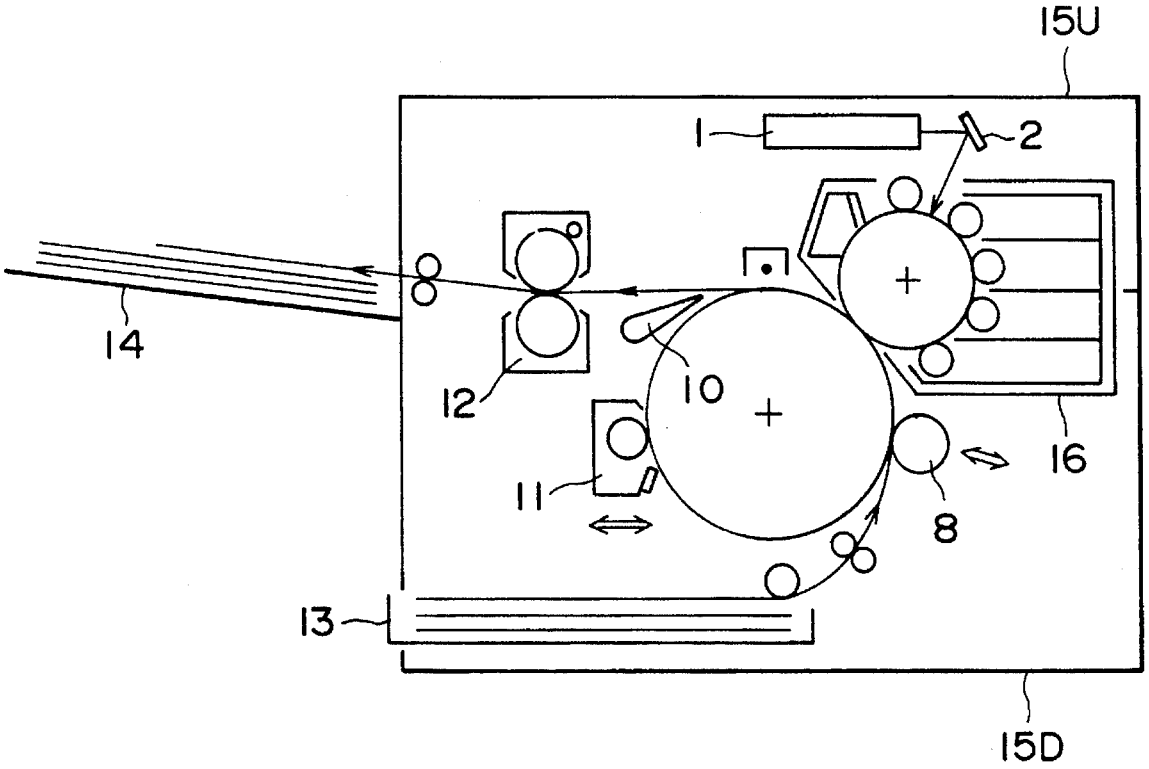
FIG. 5 shows a construction of other embodiment of the present invention.
Figure 6:
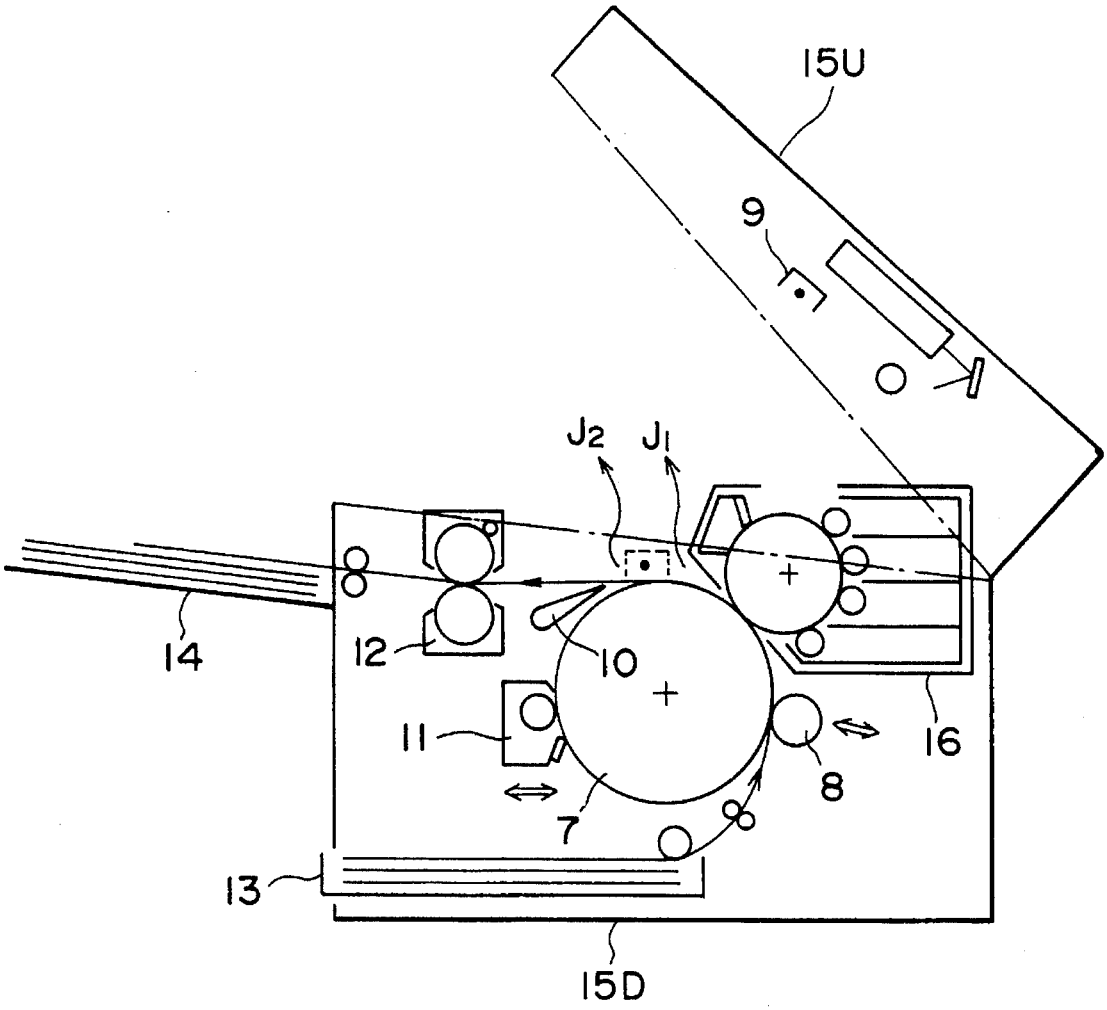
FIG. 6 shows a sectional view in which a top cover of the apparatus of FIG. 5 is opened.

Another embodiment of the present invention is now explained with reference to FIGS. 5 and 6. The same elements as those shown in the above embodiment are designated by the same numerals and the explanations thereof are omitted.

In the above embodiment, a non-woven web which is usually used is used. It has been studied in the present embodiment how the factor of the deterioration of the surface by the penetration and the deposition of the toner to the surface of the fixing roller is eliminated to extend the offset lifetime of the roller. As a result, it has been found that the degree of deterioration by the toner is significantly reduced by continuously polishing with any method the surface of the rubber roller deteriorated by the deposition of the offset toner to expose an inner portion which has not yet been attacked by the toner resin or the coloring agents. In an experiment, a conventional non-woven web is nickel-plated by an electro-deposition method to enhance a surface hardness so that the cleaning web has a polishing effect to the fixing roller. Thus, in addition to the extension effect of the offset lifetime of the roller by the polishing effect, it has been found that the roller surface is discharged because the web is conductive and it is arranged through the take-up roller, so that the surface potential is lowered to obtain an effect of prevention for the electrostatic offset of the toner.

As a result, the factors of the deterioration of the surface by the toner which uses the nickel-plated web is reduced and the coefficients $\beta$, $\gamma$, and $\delta$ are close to 1 although the difference between the coefficients $\alpha$ due to the difference between the plain paper and the OHP sheet remains at 2 to 3 and no much consideration is necessary. Accordingly, the transport distance may be changed only depending on the mode, that is, the plain paper mode or the OHP sheet mode, and the error factor of the image print factor is eliminated and the estimation of the roller lifetime by the remaining web signal is more exact than that of the conventional web.

In exchanging the unit, if a user touches the fixing unit which is at a high temperature immediately after the operation of the apparatus, there is a risk that the user may be burnt or may drop off the unit. In order to avoid such a trouble, it is preferable for the user to wait until the temperature of the unit is reduced to a room temperature after turn-off of the power supply and exchange the unit after it has sufficiently cooled. To this end, it is necessary to describe in an operation manual "Exchange at least 20 minutes after the turn-off of the power supply", but it is more preferable to use the following configuration. Namely, a temperature signal from a thermistor in the unit is monitored during the cooling of the unit, and inhibition of exchange is displayed while the temperature is high, and the permission of exchange is displayed when the unit is cooled. The display and the monitor functions may be done by providing an internal battery in the apparatus.

In the above apparatus, since the exchange path of the fixing unit extends across the top of the apparatus from the opening by the division of the casing, the oil of the fixing unit may drop to cause the contamination in the apparatus (particularly the transfer drum) when the fixing unit is exchanged. FIG. 5 shows an embodiment in which the exchange path of the fixing unit does not extend above the other process unit of the apparatus. FIG. 6 shows an open condition thereof. Thus, even if the oil drops, the risk of contamination of the apparatus is eliminated.

While preferred embodiments of the present invention have been described, the present invention is not limited to those embodiments and various modifications thereof may be made without departing from the technical concept.

What is claimed is:

1. An image forming apparatus comprising:

image forming means for forming an unfixed image on a recording medium;

a pair of fixing rotary members for fixing the unfixed image on the recording medium; and a cleaning web for cleaning a surface of one of said fixing rotary members, said cleaning web being adapted to wind up in one direction, wherein a length of said Cleaning web is set such that a completion time of winding-up is substantially equal to a time for exchanging said fixing rotary members;

said pair of fixing rotary members and said cleaning web being an integral unit separable from said apparatus, said pair of fixing rotary members and said cleaning web being exchangeable together as a unit.

2. An apparatus according to claim 1, further comprising oil supply means for supplying a releasing oil to the surfaces of said fixing rotary members, said oil supply means being included in said unit.

3. An apparatus according to claim 1, further comprising detection means for detecting a remaining quantity of said cleaning web.

* * * * *

UNITED STATES PATENT AND TRADEMARK OFFICE

CERTIFICATE OF CORRECTION

PATENT NO. : 5,559,591
DATED : September 24, 1996
INVENTOR(S) : MOTOI KATO, ET AL.

It is certified that error appears in the above-indentified patent and that said Letters Patent is hereby corrected as shown below:

COLUMN 1:

Line 43, "much poor" should read --much poorer--.

COLUMN 4:

Line 1, "toner" should read --toner.--.
Line 49, "to" should be deleted.
Line 58, "tonner" should read --toner--.

COLUMN 8:

Line 33, "Cleaning" should read --cleaning--.

Signed and Sealed this

Twenty-fifth Day of February, 1997

Bruce Lehman

*Attest:*

BRUCE LEHMAN

*Attesting Officer*

*Commissioner of Patents and Trademarks*